United States Patent [19]

Blagg et al.

[11] Patent Number: 4,552,293

[45] Date of Patent: Nov. 12, 1985

[54] CONTAINER BLANK HAVING RELIEVED EDGE CONSTRUCTION

[75] Inventors: Bobby W. Blagg, Waco, Tex.; Richard F. Gulliver, Tuscaloosa, Ala.

[73] Assignee: Gulf States Paper Corporation, Tuscaloosa, Ala.

[21] Appl. No.: 545,277

[22] Filed: Oct. 25, 1983

[51] Int. Cl.[4] ..... B65D 3/04

[52] U.S. Cl. ..... 229/1.5 B; 229/4.5; 229/21; 229/41 D

[58] Field of Search ..... 229/1.5 B, 21, 24, DIG. 4, 229/41 D, 4.5, 16 A, 3.1

[56] References Cited

U.S. PATENT DOCUMENTS

| | | | |
|---|---|---|---|
| 1,295,418 | 2/1919 | Bohlman | 229/21 |
| 2,665,837 | 1/1954 | Guyer | 229/DIG. 4 |
| 2,922,562 | 1/1960 | Pellaton | 229/16 A |
| 2,925,208 | 2/1960 | Wood | 229/21 |
| 3,381,877 | 5/1968 | Arneson | 229/1.5 B |
| 3,931,385 | 1/1976 | Sutch | 229/1.5 B X |

*Primary Examiner*—Allan N. Shoap
*Assistant Examiner*—Bryon Gehman
*Attorney, Agent, or Firm*—Cushman, Darby & Cushman

[57] ABSTRACT

A flat blank of foldable sheet material cut and scored to be erected and secured into a container comprising a pair of peripheral wall forming sections and a bottom wall forming section integrally interconnecting the peripheral sections in spaced relation. The interconnection between the bottom section and peripheral sections is along straight parallel fold lines. The bottom section has a plurality of flaps formed integrally with the remaining periphery thereof between the corresponding ends of the parallel fold lines. The interconnection between the bottom section and each of the flaps is along a straight fold line defining a portion of the periphery of the bottom section. Each peripheral section includes opposed side portions disposed outwardly of the associated parallel fold line. Each side portion provides an edge extending from the end of the associated parallel fold line which includes (1) a corner forming edge portion for engaging the fold line of the associated flap when the associated peripheral section is folded about its parallel fold line with the bottom section and the associated side portion is flexed into a position wherein the corner edge portion is engaged with the fold line of the associated flap and (2) a relieved edge portion for enabling the associated flap to be folded upwardly without interference when the corner edge portion is disposed in engaged relation to the fold line of the associated flap as aforesaid.

18 Claims, 9 Drawing Figures

CONTAINER BLANK HAVING RELIEVED EDGE CONSTRUCTION

This application relates to containers and more particularly to containers of the type capable of being erected and secured from a cut and scored flat blank.

While the container of the present invention can be utilized to contain a variety of different materials, it is particularly structured and sized to contain popcorn for consummation in movie theaters. The requirements of a container for this specific use are not as stringent as are the requirements where the container must be effective under more severe conditions for longer periods. Popcorn is relatively a very light material in terms of its bulk density, and therefore easily contained. Moreover, because the popcorn in the container is to be consumed almost immediately after being purchased at a location quite nearby to the purchase location, it can be appreciated that such popcorn containers can be of minimum sturdiness and of minimum cost. Containers of the type formed from two separate pieces are generally more sturdy and expensive than is required for theater popcorn use. These two-piece containers generally have a peripheral wall formed by one piece having a single seam. The second piece forms the bottom, usually recessed, which is separately peripherally seamed to the lower edge of the peripheral wall.

Containers made from a single flat blank have been proposed in the patented literature. One example of such a container is disclosed in U.S. Pat. No. 3,381,877. The flat blank of this patent is cut and scored from foldable sheet material to provide a pair of peripheral wall forming sections and a bottom wall forming section integrally interconnecting the pair of peripheral sections in spaced relation. In one form the bottom section is hexagonal being defined on two opposite sides by parallel fold lines constituting the integral connection between the bottom section and the peripheral sections. The other four sides are defined by straight fold lines which constitute an integral connection between the bottom section and four individual flaps. In erecting the flat blank, these flaps are shown and described as being folded inwardly and glued to the adjacent inner surface of the peripheral wall, although there is an indication in the specification that an outward securement can be effected, if desired.

While the basic setup of the flat blank in the patent can be manually erected either in the preferred manner with the flaps inwardly or otherwise with the flaps outwardly, the patented construction presents severe difficulties when efforts are made to mechanize the erecting procedure. Simplicity in the mechanism is a highly desirable attribute and the greatest simplicity is derived when erection can be completed by utilizing a mandrel having a shape corresponding to the interior of the container and simply folding the various sections and flaps thereover.

An object of the present invention is the provision of a flat blank of the type described which is capable of simple erection by an inexpensive mechanism which can be operated at optimum speeds. In accordance with the principles of the present invention, the flat blank embodies the same basic construction as disclosed in the aforesaid patent, namely, a pair of peripheral wall forming sections integrally interconnected by a bottom section which preferably is of hexagonal configuration. However, the flat blank of the present invention is formed with edge configurations along the bottom of the side portions of the peripheral sections which enable simple erection of the flat blank in which the flaps are folded upwardly in outwardly overlying relation thereto without interference. More specifically, the aforesaid edge in each side portion of each peripheral section which extends from the end of the associated bottom fold line includes (1) a corner edge portion for engaging the fold line of the associated flap when the associated peripheral section is folded about its parallel fold line with the bottom section and the associated side portion is flexed into a position wherein the corner edge portion is engaged with the fold line of the associated flap and (2) a relieved edge portion for enabling the associated flap to be folded upwardly without interference when the corner edge portion is disposed in engaged relation to the fold line of the associated flap as aforesaid.

Preferably each of the aforesaid edges also includes a second spaced corner forming edge portion for engaging the opposite end of the associated fold line engaged by the associated first corner edge portion. Preferably, the second corner edge portion is pointed so as to be slightly flattened when engaged with the fold line to insure that the corner of the erected container is solid and does not contain a leak opening.

Another object of the present invention is the provision of a flat blank and container made therefrom which is simple in construction, economical to manufacture, and effective in operation.

These and other objects of the present invention will become more apparent during the course of the following detailed description and appended claims:

The invention may best be understood with reference to the accompanying drawings wherein illustrative embodiment is shown.

Figure 1:
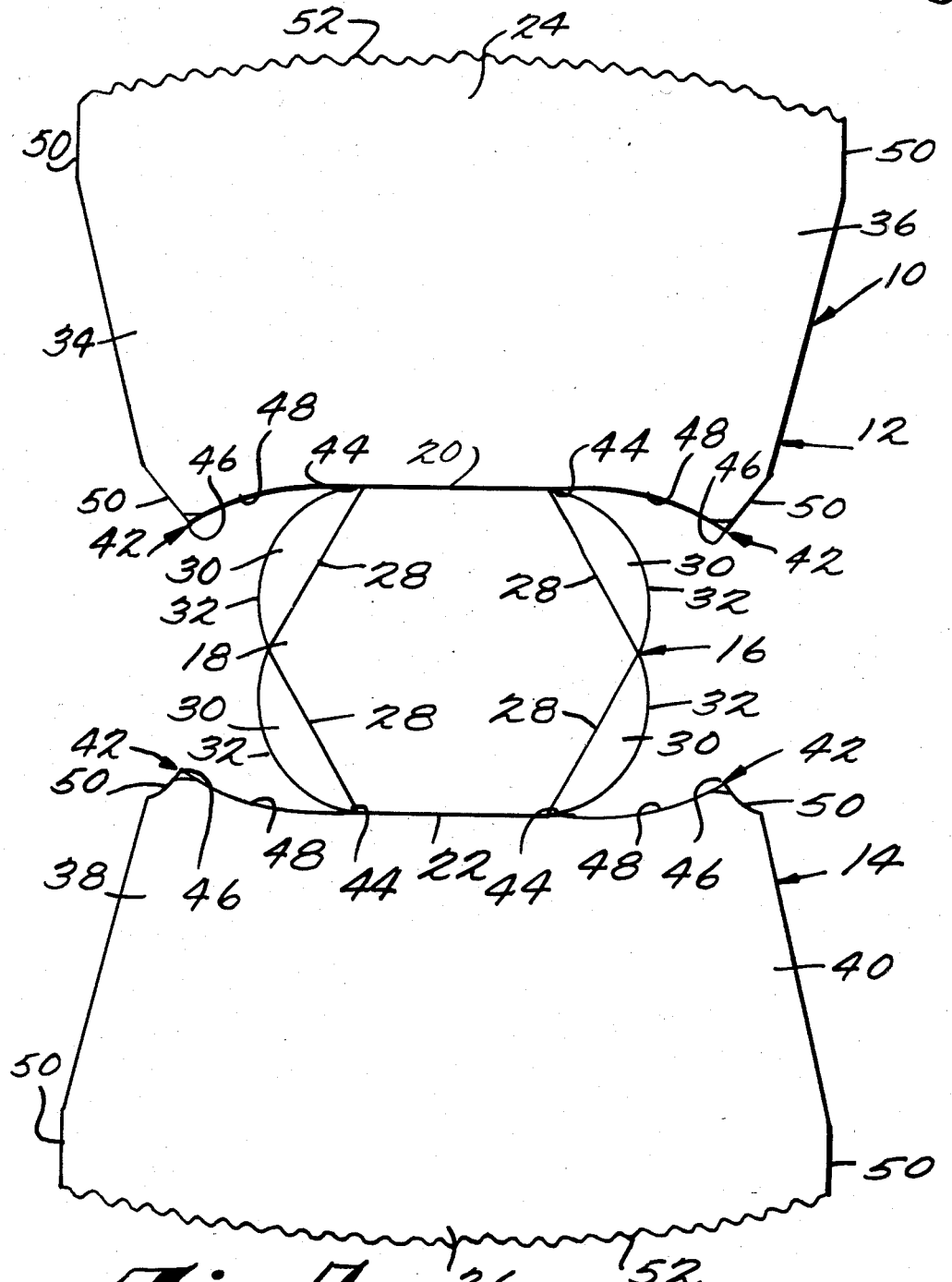
FIG. 1 is a top plan view of a flat blank of foldable sheet material cut and scored to be erected and secured into a container which embodies the principles of the present invention.
Figure 2:
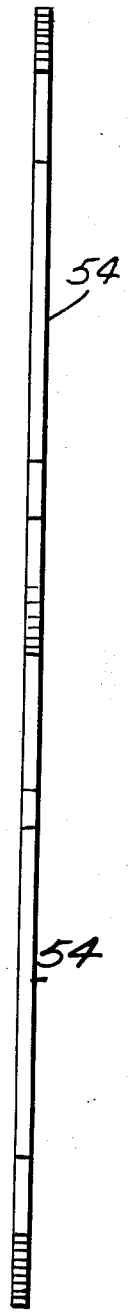
FIG. 2 is a side elevational view of the flat blank shown in FIG. 1.

Referring now more particularly to FIGS. 1 and 2 of the drawings, there is shown therein a flat blank, generally indicated at 10, which is constructed in accordance with the principles of the present invention. The flat blank 10 is cut and scored from suitable foldable sheet material, as, for example, kraft paper or the like. The flat blank 10 is cut and scored to provide a pair of peripheral wall forming sections, generally indicated at 12 and 14, which are integrally interconnected in space relation by a bottom wall forming section, generally indicated at 16.

The bottom section 16 includes a bottom wall portion 18 which, as shown, is preferably of hexagonal configuration. The six sides of the bottom wall portion 18 are defined by six straight fold lines, two opposed parallel fold lines 20 and 22 being common to the central portions 24 and 26 respectively of the peripheral sections 12 and 14 so as to constitute the integral connections between bottom section 16 and the peripheral sections 12 and 14. The remaining four sides of the bottom wall portion 18 are defined by four fold lines 28 each of which is common to a separate bottom flap 30. Each flap 30 is defined by the associated fold line 28 and a generally convexly arcuate edge 32 extending between the ends of the associated fold line 28.

The peripheral section 16 includes opposed side portions 34 and 36 on opposite sides of the central portion 24 thereof common to associated fold line 20. Likewise, the peripheral section 14 includes opposed side portions 38 and 49 extending on opposite sides of the central portion 26 thereof common to the fold line 22. Each of side portions 34, 36, 38 and 40 is formed with a similar lower edge construction, generally indicated at 42, which embodies the principles of the present invention. Each of the edge constructions 42 constitutes the edge of the associated portion which extends from the end of the associated parallel fold line 20 or 22.

Each edge construction 42 includes a corner forming edge portion 44 adjacent the associated parallel fold line which serves to engage the fold line 28 of the associated flap 30 when the associated peripheral section is folded about its parallel fold line with the bottom section and the associated side portion is flexed into a position wherein the corner edge portion 44 is engaged with the fold line 28 of the associated flap. Each edge construction 42 also includes a spaced second corner forming edge portion 46. As shown, each corner edge portion 46 is of pointed configuration so that when it is engaged with the opposite end of the associated fold line 28 of the associated flap 30, it will be slightly flattened. Finally, each edge construction 42 also includes a relieved portion 48 extending between the two corner edge portions 44 and 46 so as to enable the associated flap 30 to be folded upwardly without interference when the corner edge portions are disposed in engaged relation to the ends of the fold line of the associated flap as previously indicated. Each relieved edge portion 48 is of concavely arcuate configuration, having a radius of curvature which is substantially greater than the radius of curvature of the convexly arcuate free edge 32 of the associated flap 30.

Each of the side portions 34, 36, 38 and 40 define a side edge of the associated peripheral section 12 or 14. The opposite end corners of each of the side edges are diagonally cut off, as indicated at 50. It will also be noted that the edge of each peripheral section 12 or 14 opposite from the associated fold line 20 or 22 is provided with a scalloped configuration as indicated at 12.

The flat blank 10 is erected and secured into a container by simply positioning the flat blank centrally over a mandrel having an exterior configuration corresponding with the interior configuration of the erected container.

After the flat blank is positioned over the mandrel, strips of adhesive 54 are applied along the exterior side margins of the side portions 34 and 36 and along the exterior margins of all four edge constructions 42. It will be understood that any type of adhesive may be used and that the adhesive may be applied prior to the positioning of the blank on the mandrel. A preferred adhesive is a thermosetting resin adhesive such as a hot melt adhesive. As soon as the adhesive application has been completed, erection preferably proceeds in the following manner.

Figure 3:
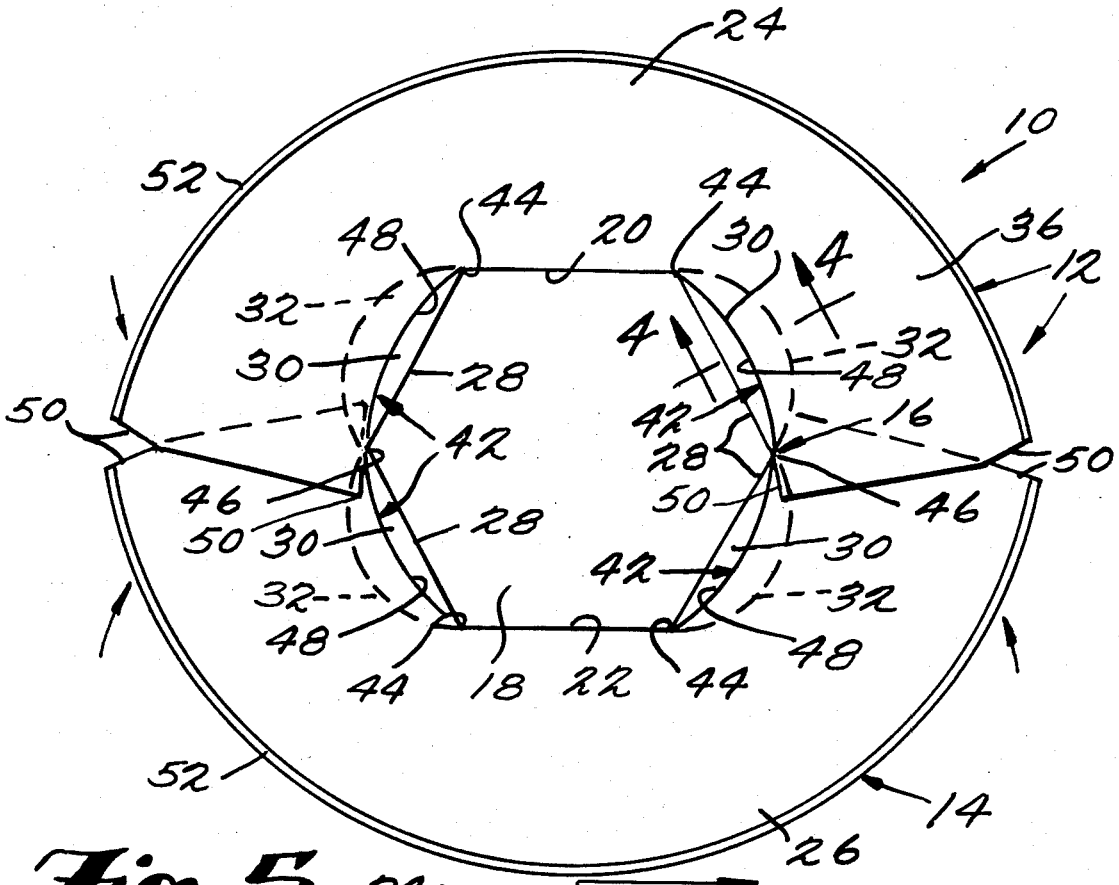
FIG. 3 is a top plan view illustrating an interim position of the flat blank during the erecting procedure.
Figure 5:
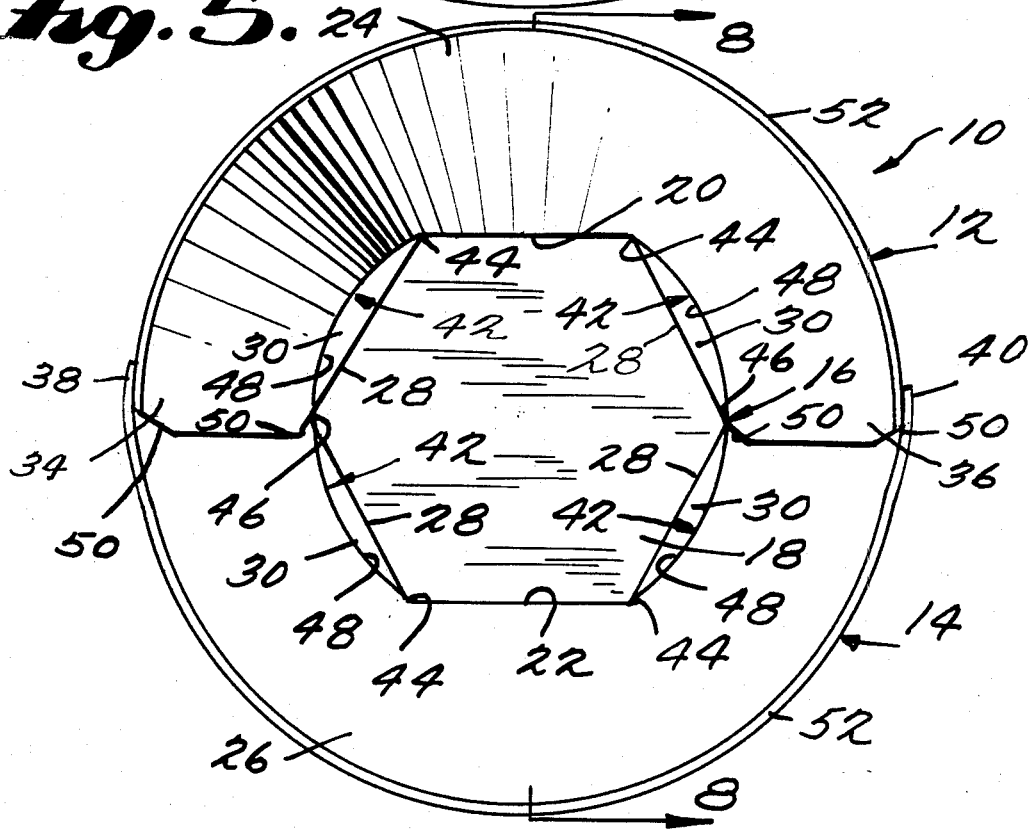
FIG. 5 is a top plan view of the completely erected carton.
Figure 6:
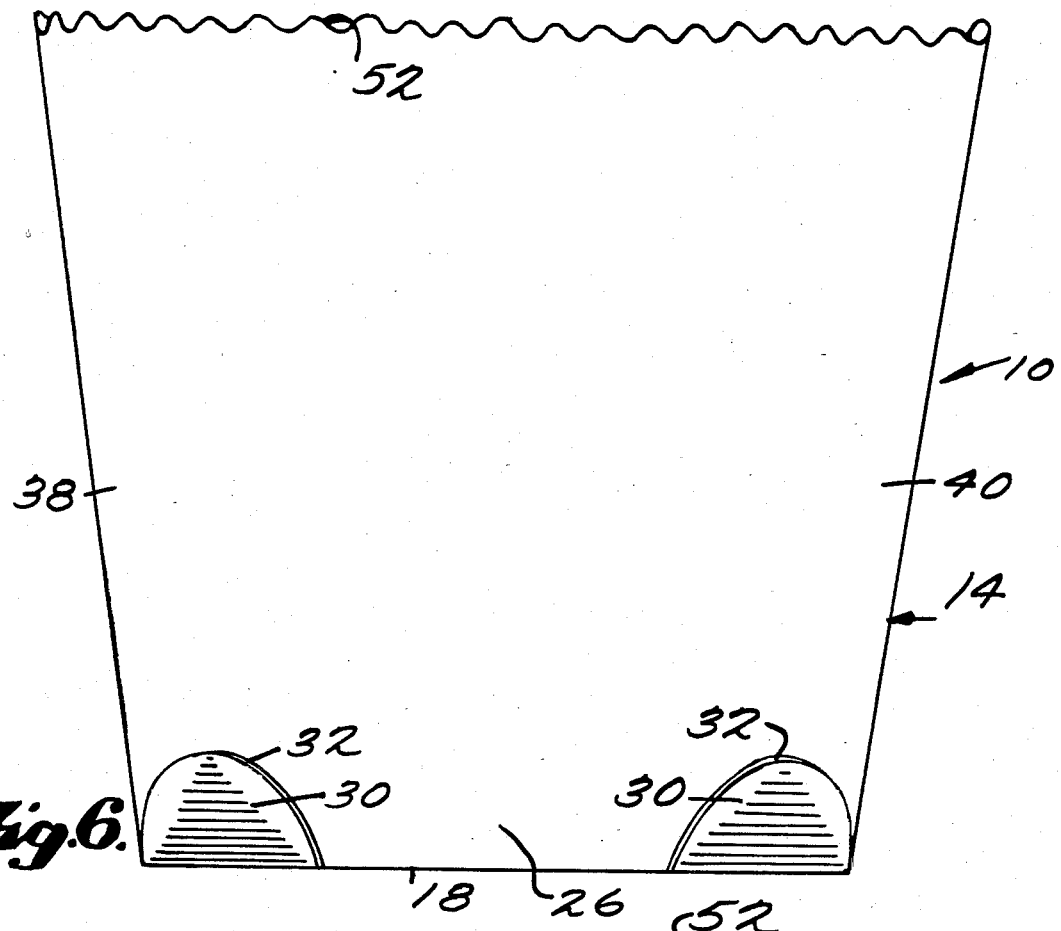
FIG. 6 is a front elevational view of the erected carton shown in FIG. 5.
Figure 7:
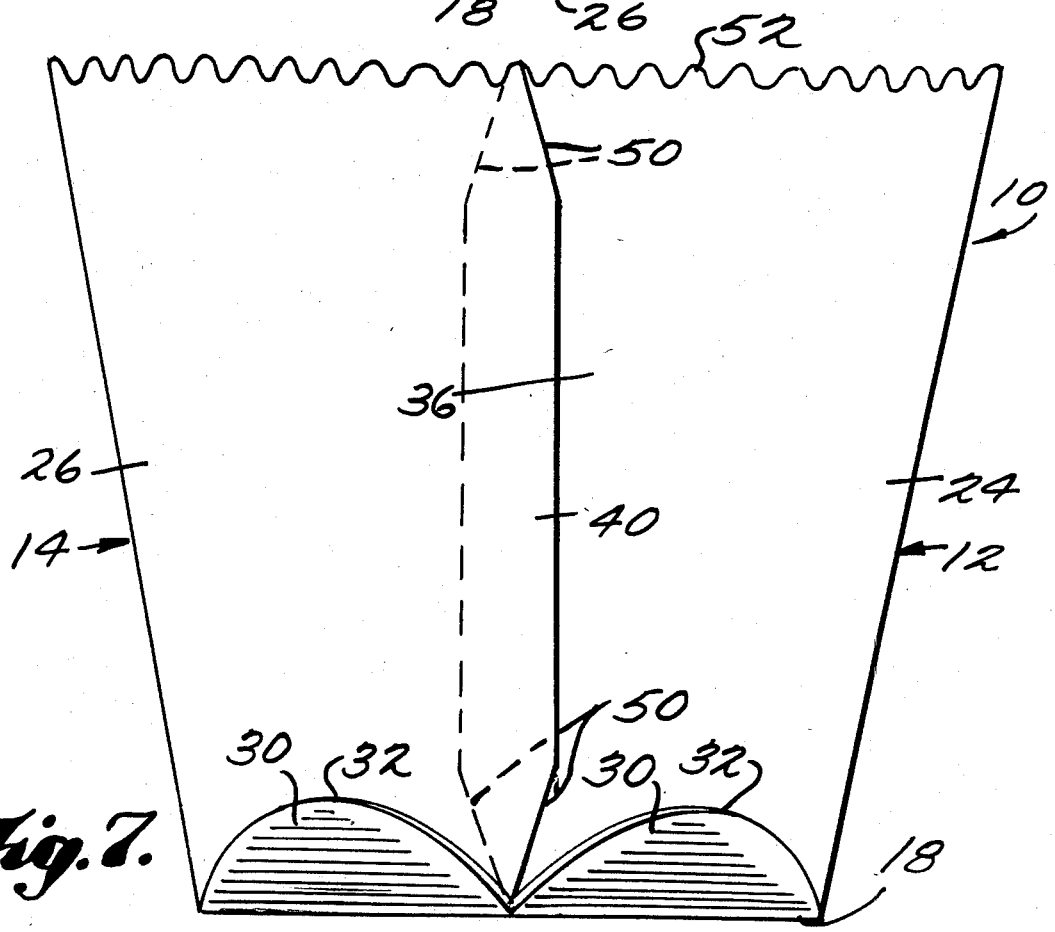
FIG. 7 is a side elevational view of the carton shown in FIG. 5.
Figure 8:
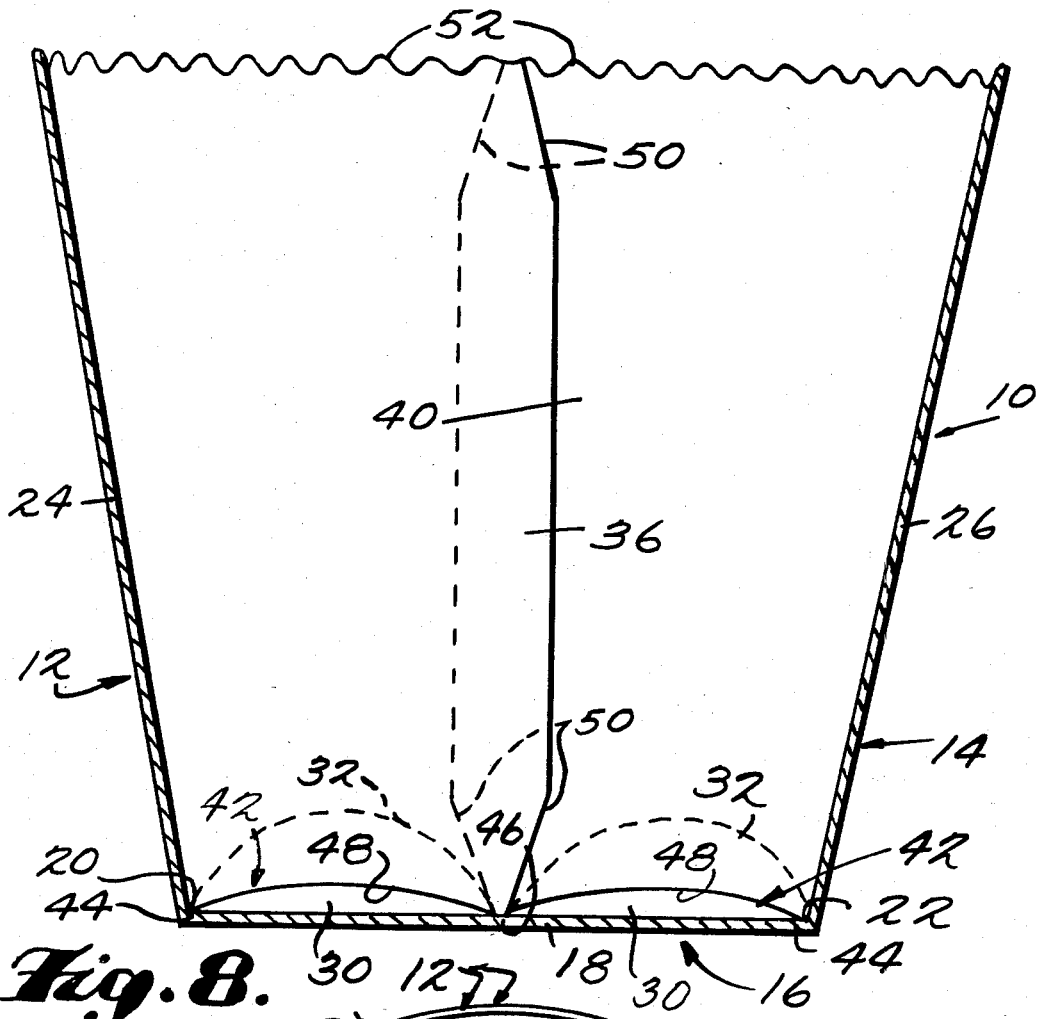
FIG. 8 is a sectional view taken along the line of 8—8 of FIG. 5.

The side walls 38 and 40 are first deflected inwardly and then the side portions 34 and 36 are thereafter deflected inwardly so that their side margins, with the hot melt 54 applied to the exterior thereof, are disposed inwardly of the side margins of the side portions 38 and 40. As best shown in FIG. 3, as this movement continues, side portions 38 and 40 are brought into full overlapping engagement with the side portions 34 and 36 for retention therein by the hot melt 54 and the corner edge portions 46 and 44 of each of the edge constructions 42 are positioned into engagement with the ends of associated fold line 28 with the associated flap 70 extending outwardly therefrom. It will be noted that each side portion 34, 36, 38 and 40 is flexed in order to accomplish the engagement. This flexure tends to displace each relieved edge portion 48 into a position which is spaced horizontally outwardly from the associated flap fold line 28.

Figure 4:
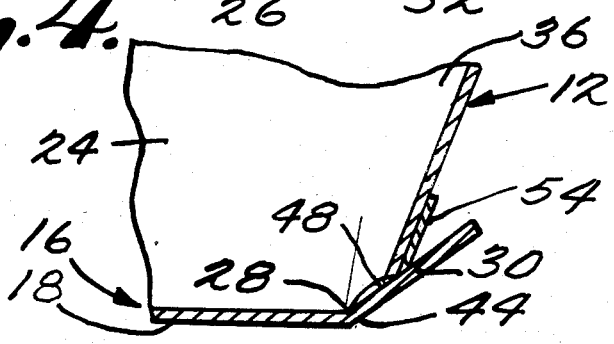
FIG. 4 is an enlarged fragmentary sectional view taken along the line of 4—4 of FIG. 3.

In the absence of the relieved configuration of the edge portions 48, the central portion of the edge construction 42 would engage the associated flap in spaced relationship to the fold line 28 when the flap is in a horizontal condition, thus interfering with the upward movement of the flap necessary to complete the erection of the container. As shown in FIG. 4, with the relieved edge portion 48, flap 30 can be hinged upwardly about its fold line 28 substantially to a 45° angle or more before the relieved edge portion 48 is engaged. At this angle no significant interference to the further movement of the flap can take place and the adjacent side wall portion simply moves inwardly from its flexed out condition as the flap is moved into its final erected position in flush engagement with the outside surface of the adjacent side portion so that the hot melt 54 thereon will retain the flap in position.

Where the edges of the flat blank comparable to the edge constructions 42 of the present invention are straight, as shown in U.S. Pat. No. 3,381,877, time robbing difficulties and unreliability would be presented during erection because the flexure of the side portion spans the central portion of the straight edge from the fold line of the flap if the latter is disposed outwardly, thus interferring with the upward fold of the flap. This may well account for the preferred inboard mounting.

Figure 9:
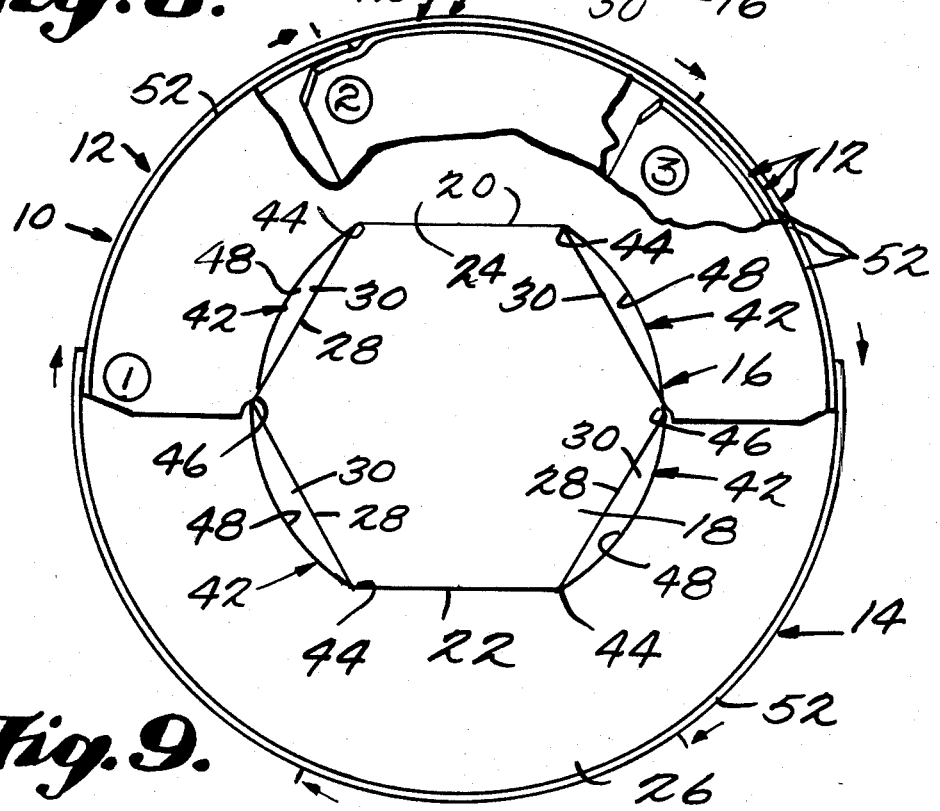
FIG. 9 is a top plan view with certain parts broken away illustrating a preferred manner of stacking a plurality of cartons.

FIG. 9 illustrates a preferred manner of stacking a plurality of containers in nested relation. In order to prevent the lapped marginal edges of the side portions from causing a nested stack of containers from elongating in that direction, each successive container is turned or rotated about its axis approximately 60°.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A flat blank of foldable sheet material cut and scored to be erected and secured into a container comprising a pair of peripheral wall forming sections and a bottom wall forming section integrally interconnecting said pair of peripheral sections in spaced relation, the interconnection between said bottom section and said pair of peripheral sections being along straight parallel fold lines, said bottom section having a plurality of flaps formed integrally with the remaining periphery thereof between the corresponding ends of said parallel fold lines, the interconnection between said bottom section and each of said flaps being along a straight fold line defining a portion of the periphery of the bottom section, each peripheral section including opposed side portions disposed outwardly of the associated parallel fold line, each side portion providing an edge extending from the end of the associated parallel fold line which includes (1) a corner forming edge portion for engaging the fold line of the associated flap when the associated peripheral section is folded about its parallel fold line with the bottom section and the associated side portion is flexed into a position wherein the corner edge portion is engaged with the fold line of the associated flap and (2) a relieved edge portion for enabling the associated flap to be folded upwardly without engagement between the relieved edge portion and the interior surface of the associated flap as the flap is folded upwardly when the corner edge portion is disposed in engaged relation to the fold line of the associated flap as aforesaid to a position insuring that further upwardly folded movement of the flap will cause the adjacent side portion to move simply without interference between the relieved edge portion and the interior surface of the associated flap into surface to surface engagement therewith.

2. A flat blank as defined in claim 1 wherein said bottom section is of hexagonal configuration having six sides, said parallel fold lines defining two opposite sides of said hexagonal configuration, each of the remaining four sides being defined by the straight fold line of a single flap.

3. A flat blank as defined in claim 2 wherein the edge provided in each side portion which extends from the end of the associated parallel fold line further includes a second corner forming edge portion spaced from the associated first-mentioned corner edge portion for engaging the opposite end of the associated fold line engaged by the associated first corner edge portion.

4. A flat blank as defined in claim 3 wherein each second corner edge portion is of pointed configuration capable of being slightly flattened when engaged with the associated fold line opposite end.

5. A flat blank as defined in claim 3 wherein opposite end corners of each side portion margin positioned outwardly with respect to the side portion margin disposed in lapped relation therewith are diagonally cut off.

6. A flat blank as defined in claim 3 wherein each of said relieved edge portions is of concavely arcuate configuration.

7. A flat blank as defined in claim 6 wherein each flap is defined peripherally by the associated straight fold line and generally convexly arcuate edge extending between the ends of the associated straight fold line.

8. A flat blank as defined in claim 7 wherein the radius of curvature of each concavely relieved edge portion is substantially greater than the radius of curvature of the associated convexly arcuate flap edge.

9. A container made from a flat blank of foldable sheet material comprising a pair of peripheral wall forming sections and a bottom wall forming section integrally interconnecting said pair of peripheral sections in spaced relation by a bottom wall forming section, the interconnection between said bottom section and said pair of peripheral sections being along straight parallel fold lines, said bottom section having a plurality of flaps formed integrally with the remaining periphery thereof between the corresponding ends of said parallel fold lines, the interconnection between said bottom section and each of said flaps being along a straight fold line defining a portion of the periphery of the bottom section, each peripheral section including opposed side portions disposed outwardly of the associated parallel fold line, each side portion providing an edge extending from the end of the associated parallel fold line which includes (1) a corner forming edge portion for engaging the fold line of the associated flap when the associated peripheral section is folded about its parallel fold line with the bottom section and the associated side portion is flexed into a position wherein the corner edge portion is engaged with the fold line of the associated flap and (2) a relieved edge portion for enabling the associated flap to be folded upwardly without engagement between the relieved edge portion and the interior surface of the associated flap as the flap is folded upwardly when the corner edge portion is disposed in engaged relation to the fold line of the associated flap as aforesaid upwardly to a position insuring that further upwardly folded movement of the flap will cause the adjacent side portion to move simply without interference between the relieved edge portion and the interior surface of the associated flap into surface to surface engagement therewith, means for securing adjacent margins of adjacent side portions of said pair of peripheral sections in lapped relation to form the peripheral wall of said container, and means for securing said flaps in upwardly folded surface to surface relation to the exterior surfaces of the adjacent side portions so as to provide an interconnection between said bottom section and said side portions with together with said straight parallel fold lines complete a lower peripheral interconnection between the bottom wall of the container formed by said bottom wall section and the peripheral wall of the container formed by the peripheral sections with said margins secured in lapped relation.

10. A container as defined in claim 9 wherein said bottom section is of hexagonal configuration having six sides, said parallel fold lines defining two opposite sides of said hexagonal configuration, each of the remaining four sides being defined by the straight fold line of a single flap.

11. A container as defined in claim 10 wherein the edge provided in each side portion which extends from the end of the associated parallel fold line further includes a second corner forming edge portion spaced from the associated first-mentioned corner edge portion for engaging the opposite end of the associated fold line engaged by the associated first corner edge portion.

12. A container as defined in claim 11 wherein each second corner edge portion is of pointed configuration slightly flattened in engagement with the associated fold line opposite end.

13. A container as defined in claim 11 wherein opposite end corners of each side margin positioned outwardly with respect to the side portion margin disposed in lapped relation therewith are diagonally cut off.

14. A container as defined in claim 11 wherein each of said relieved edge portions is of concavely arcuate configuration.

15. A container as defined in claim 14 wherein each flap is defined peripherally by the associated straight fold line and generally convexly arcuate edge extending between the ends of the associated straight fold line.

16. A container as defined in claim 15 wherein the radius of curvature of each concavely arcuate relieved edge portion is substantially greater than the radius of curvature of the associated convexly arcuate flap edge.

17. A container as defined in claim 11 wherein said lapped margin securing means comprises a hot melt adhesive.

18. A container as defined in claim 11 wherein said flap securing means comprises a hot melt adhesive.

* * * * *